US010167002B2

(12) United States Patent
Chen et al.

(10) Patent No.: US 10,167,002 B2
(45) Date of Patent: Jan. 1, 2019

(54) METER GAUGE POWER BOGIE AND METER GAUGE VEHICLE

(71) Applicant: CRRC TANGSHAN CO., LTD., Tangshan (CN)

(72) Inventors: Yanhong Chen, Tangshan (CN); Dongjie Jiang, Tangshan (CN); Chengwei Qin, Tangshan (CN); Junfeng Wang, Tangshan (CN); Mingquan Bao, Tangshan (CN)

(73) Assignee: CRRC Tangshan Co., Ltd., Hebei (CN)

( * ) Notice: Subject to any disclaimer, the term of this patent is extended or adjusted under 35 U.S.C. 154(b) by 60 days.

(21) Appl. No.: 15/384,260

(22) Filed: Dec. 19, 2016

(65) Prior Publication Data

US 2017/0101114 A1 Apr. 13, 2017

Related U.S. Application Data

(63) Continuation of application No. PCT/CN2015/093687, filed on Nov. 3, 2015.

(30) Foreign Application Priority Data

Dec. 23, 2014 (CN) ..... 2014 1 0814564

(51) Int. Cl.
*B61F 3/04* (2006.01)
*B61F 5/30* (2006.01)
*B61C 9/48* (2006.01)

(52) U.S. Cl.
CPC ..... *B61F 5/30* (2013.01); *B61C 9/48* (2013.01); *B61F 3/04* (2013.01)

(58) Field of Classification Search
CPC ..... B61F 3/04; B61F 5/30; B61C 9/38; B61C 9/44; B61C 9/48; B61C 9/50
(Continued)

(56) References Cited

U.S. PATENT DOCUMENTS 2,023,481 A 12/1935 Levin ..... 308/207
2,234,070 A 3/1941 Barton ..... 105/113
(Continued)

FOREIGN PATENT DOCUMENTS

CN 201769828 U 3/2011
CN 202016473 U 10/2011
(Continued)

OTHER PUBLICATIONS

International Search Report of corresponding International PCT Application No. PCT/CN2015/093687, dated Feb. 16, 2016.
(Continued)

*Primary Examiner* — Mark T Le
(74) *Attorney, Agent, or Firm* — J.C. Patents

(57) ABSTRACT

A meter gauge power bogie and a meter gauge vehicle, the meter gauge power bogie includes two wheelsets, a framework arranged on the wheelsets and a driving device, the wheelset includes an axle extending along the width of the vehicle body and wheels press-fitted with the axle and located at both ends of the axle, a traction motor is arranged at a front side or a rear side of a rolling axial suspension box, and via the rolling axial suspension box enclosing an axle of the driving device of the bogie and a gearbox being arranged between ends of the traction motor and the rolling axial suspension box at the same side and the corresponding wheel, the rolling axial suspension box, the traction motor and the gearbox are fixedly connected, and thus form an integral structure.

7 Claims, 4 Drawing Sheets

(58) Field of Classification Search
USPC ..... 105/136
See application file for complete search history.

(56) References Cited

U.S. PATENT DOCUMENTS

| | | | | | |
|---|---|---|---|---|---|
| 3,667,318 | A * | 6/1972 | Lock | F16H 57/028 | 105/140 |
| 3,727,483 | A * | 4/1973 | Hanson | F16H 57/03 | 105/140 |
| 5,951,081 | A * | 9/1999 | Foster | B60B 17/00 | 295/36.1 |
| 8,171,861 | B2 * | 5/2012 | Rodet | B61F 3/04 | 105/136 |
| 8,881,658 | B2 * | 11/2014 | Starbatty | B61C 9/48 | 105/133 |

FOREIGN PATENT DOCUMENTS

| | | | |
|---|---|---|---|
| CN | 103097223 | A | 5/2013 |
| CN | 103496380 | A | 1/2014 |
| CN | 103625494 | A | 3/2014 |
| CN | 103693050 | A | 4/2014 |
| CN | 203681547 | U | 7/2014 |
| CN | 104401346 | A | 3/2015 |
| CN | 104477196 | A | 4/2015 |
| DE | 3618308 | A1 | 12/1987 |
| DE | 10 2007 013 050 | A1 | 9/2008 |
| EP | 0 857 636 | A2 | 8/1998 |
| GB | 00672 | | 1/1914 |
| GB | 731979 | | 6/1955 |
| GB | 810961 | | 3/1959 |
| GB | 1181299 | | 2/1970 |
| JP | 54-65910 | * | 5/1979 |
| NL | 79246 | | 10/1955 |
| WO | WO 2012/123438 | A1 | 9/2012 |
| WO | WO 2012/135991 | A1 | 10/2012 |

OTHER PUBLICATIONS

Chinese First Examination Report of corresponding China patent Application No. 201410814564.9, dated Apr. 29, 2016.

The extended European Search Report of corresponding European patent application No. 15871782.7-1010/3241715, dated Jul. 2, 2018.

* cited by examiner

METER GAUGE POWER BOGIE AND METER GAUGE VEHICLE

CROSS-REFERENCE TO RELATED APPLICATIONS

This application is a continuation of International Application No. PCT/CN2015/093687, filed on Nov. 3, 2015, which claims the priority benefit of China Patent Application No. 201410814564.9, filed on Dec. 23, 2014. The contents of the above identified applications are incorporated herein by reference in their entireties.

TECHNICAL FIELD

Embodiments of the present invention relate to the communication technology, and especially to a meter gauge power bogie and a meter gauge vehicle.

BACKGROUND

A bogie is a portion by means of which a railway vehicle runs, and is crucial to safe running of a vehicle, as the bogie connected steel rails with a vehicle body while playing the role of guiding, reducing vibrations of and braking a vehicle. The bogie of a passenger vehicle, in particular, requires good running stability and safety and comfort besides sufficient strength, for the purpose of guaranteeing the safety and comfort of passengers.

Due to a narrow rail gauge of the meter gauge railway (typically 1000 mm), low costs of railway lines and vehicles, as well as fine curve trafficability resulted from a small minimum railway curve radius of a meter gauge vehicle, meter gauge railway lines are built up in a plurality of countries. However, the bogie of the meter gauge railway suffers from a narrow distance between two wheels under limitation by the rail gauge, therefore, the space for a driving device to be mounted therein is limited. Currently, the driving device of a meter gauge power bogie includes a traction motor, a gearbox and a dental coupling installed between the traction motor and the gearbox, in which a housing of the traction motor is fixed on the framework of the bogie via a connecting piece, the box body of the gearbox is fixed on the framework via a derrick, one end of the dental coupling is fixed with the motor shaft of the traction motor, the other end is connected with an input shaft of the gearbox. The integral structure takes up large space due to the fact that the connecting piece, the derrick and the dental coupling all require certain space to be arranged therein; in addition, the fact that the power of the traction motor is in direct proportion to its volume poses a limitation to the power of the traction motor available to this type of driving device, which in turn seriously restricts improvement in the speed of a vehicle.

SUMMARY

In view of the above drawbacks in the prior art, the present invention provides a new type of meter gauge power bogie and meter gauge vehicle, so as to simplify the structure of a driving device of the bogie, and improve the traction power of the driving device.

To achieve the above objective, one aspect of the present invention provides a meter gauge power bogie, including two wheelsets arranged in a longitudinal direction of a vehicle body, a framework arranged on the wheelsets, the wheelset includes an axle extending along the width of the vehicle body and wheels press-fitted with the axle and located at both ends of the axle, wherein, the meter gauge power bogie also includes:

a driving device, which includes a rolling axial suspension box enclosing the axle between the two wheels, and the rolling axial suspension box is mounted on the axle via a rolling bearing; a traction motor is arranged on the front side or the rear side of the rolling axial suspension box, and a gearbox is arranged between ends of the traction motor and the rolling axial suspension box at the same side and the corresponding wheel; the rolling axial suspension box is fixedly connected with a housing of the traction motor, the rolling axial suspension box and a housing of the traction motor are respectively fixedly connected with a box body of the gearbox; the housing of the traction motor is connected with the framework via a motor derrick; a first gear and a second gear are at least provided within the gearbox, the first gear is sleeved around a motor shaft of the traction motor in a fixed manner, and the second gear is sleeved around the axle in a fixed manner.

Another aspect of the present invention provides a meter gauge vehicle, including the above meter gauge power bogie, as well as the vehicle body arranged on the meter gauge power bogie.

In the meter gauge power bogie and the meter gauge vehicle provided by the present invention, a traction motor is arranged at a front side or a rear side of a rolling axial suspension box, via the rolling axial suspension box enclosing an axle of a driving device of the bogie, a gearbox is arranged between ends of the traction motor and the rolling axial suspension box at the same side and the corresponding wheel, every two of the rolling axial suspension box, a housing of the traction motor and the box body of the gearbox are fixedly connected, thus the rolling axial suspension box, the traction motor and the gearbox form an integral structure, which may be connected with a framework via a motor derrick, rendering the structure of the driving device more compact, thus saving space for mounting the traction motor.

BRIEF DESCRIPTION OF THE DRAWINGS

The present invention will be further described as follows in conjunction with the accompanying drawings and embodiments, in the drawings.

DESCRIPTION OF EMBODIMENTS

In order to make the objectives, technical solutions and advantages of embodiments of the present invention clearer, the technical solutions in the embodiments of the present invention will be clearly and completely described in conjunction with accompanying drawings and the embodiments of the present invention. Obviously, the described embodiments are just part rather than all embodiments of the present invention. And all the other embodiments obtained by those skilled in the art based on the embodiments of the present invention without delivering creative efforts shall fall into the protection scope of the present invention.

Figure 1:
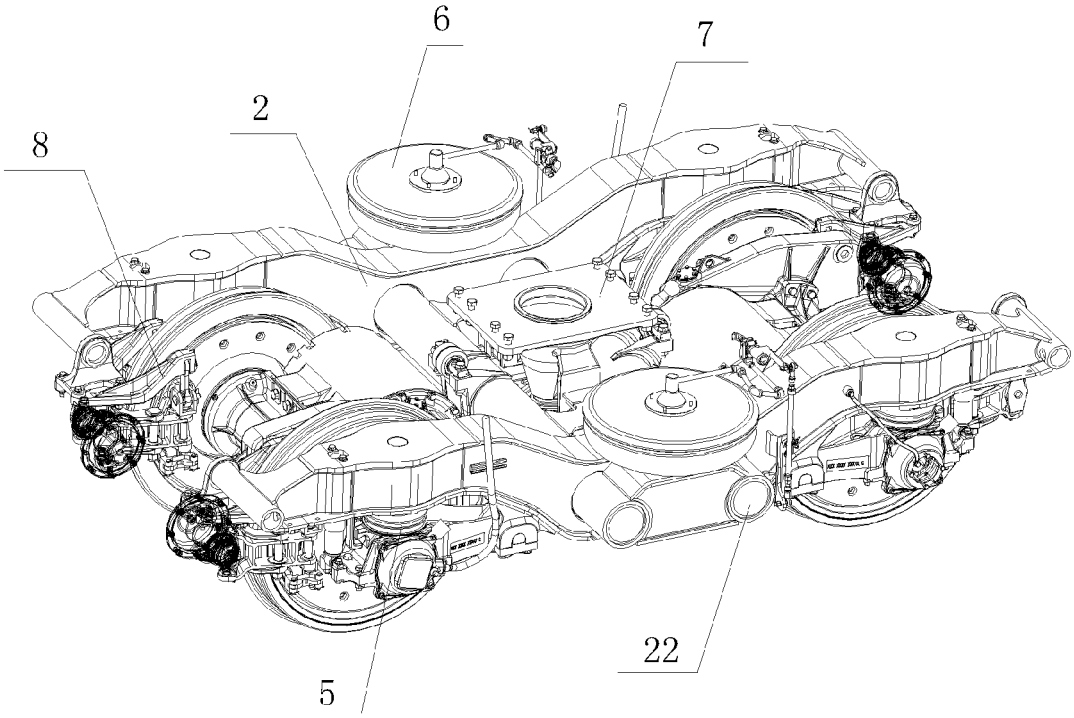
FIG. 1 is a structural diagram of a meter gauge power bogie involved in the present invention.
Figure 2:
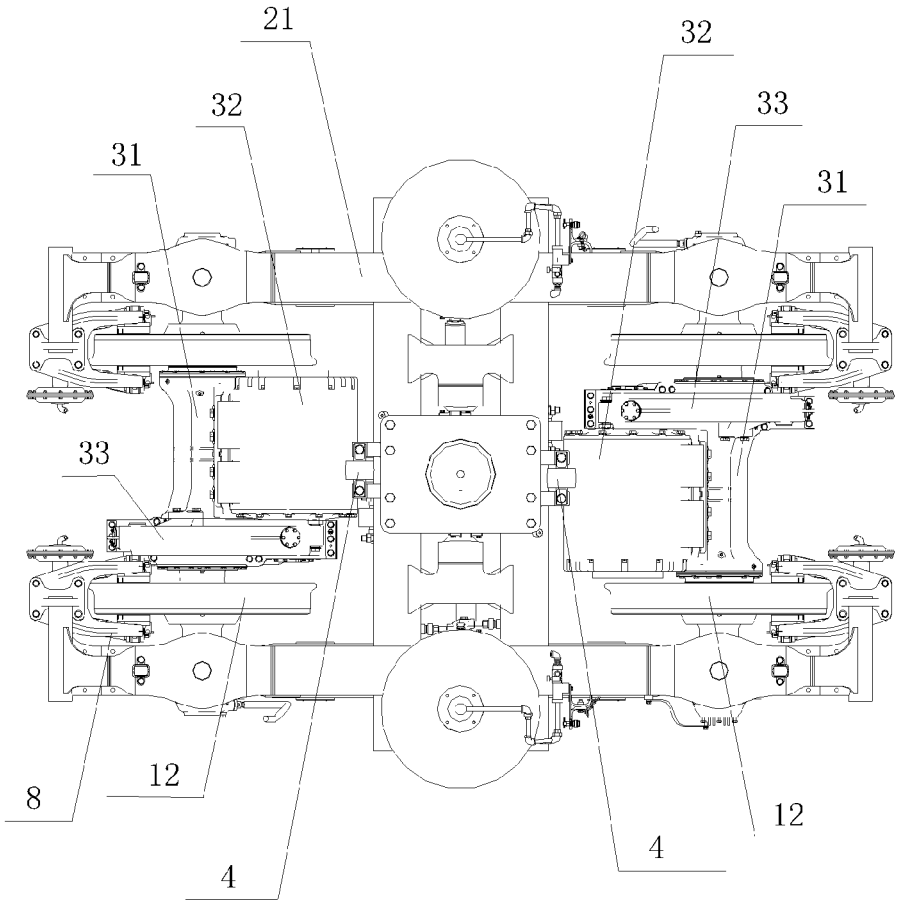
FIG. 2 is a top view of the meter gauge power bogie involved in the present invention.
Figure 3:
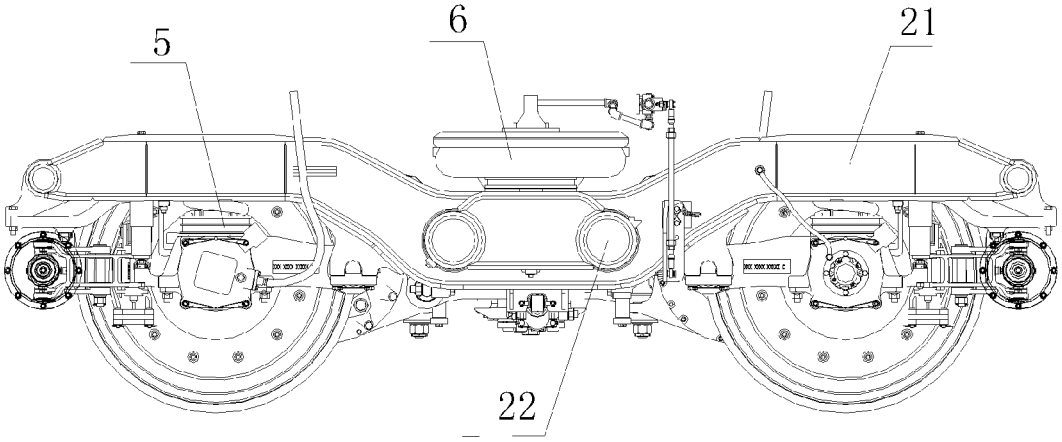
FIG. 3 is a side view of the meter gauge power bogie involved in the present invention.
Figure 4:
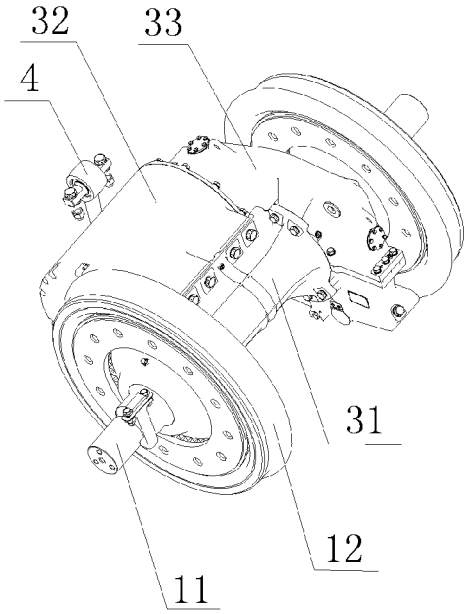
FIG. 4 is a structural diagram of a driving device of the meter gauge power bogie involved in the present invention.
Figure 5:
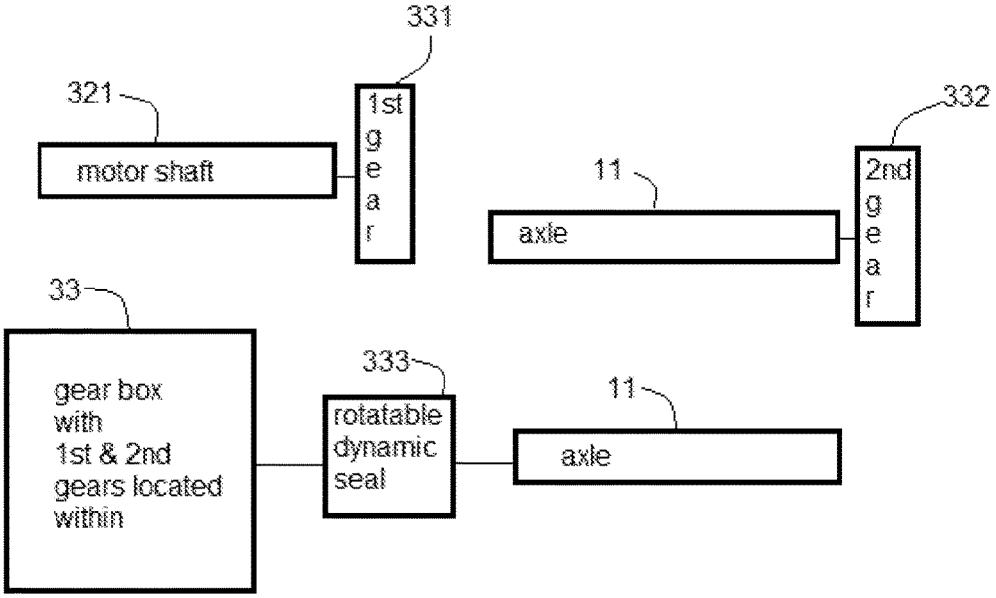
FIG. 5 is a box diagram showing relationships of bogie componets.

FIG. 1 is a structural diagram of a meter gauge power bogie involved in the present invention; FIG. 2 is a top view of the meter gauge power bogie involved in the present invention; FIG. 3 is a side view of the meter gauge power bogie involved in the present invention; FIG. 4 is a structural diagram of a driving device of the meter gauge power bogie involved in the present invention; and FIG.5 is a box diagram showing relationships of bogie components. In conjunction with FIGS. 1-5, the meter gauge power bogie provided by the present invention includes two wheelsets arranged in a longitudinal direction of the vehicle body, a framework 2 arranged on the two wheelsets, the wheelset includes an axle 11 extending along the width of the vehicle body as well as wheels 12 sleeved around the axle 11 and located at both ends thereof, and the meter gauge power bogie also includes:

a driving device, including a rolling axial suspension box 31 enclosing around the axle 11 between the two wheels 12, and the rolling axial suspension box 31 is mounted on the axle 11 via a rolling bearing; a front side or a rear side of the rolling axial suspension box 31 is provided with a traction motor 32, and a gearbox 33 is arranged between the same ends of the traction motor 32 and the rolling axial suspension box 31 and the corresponding wheels 12; a housing of the rolling axial suspension box 31 and a housing of the traction motor 32 are fixedly connected, the housing of the rolling axial suspension box 31 and the housing of the traction motor 32 are respectively fixedly connected with the box body of a gearbox 33; the housing of the traction motor 32 is connected with the framework 2 through a motor derrick 4; and as showen in FIG. 5, a first gear 331 and a second gear 332 are at least provided within the gearbox 33, the first gear 331 is press-fitted with a motor shaft 321 of the traction motor 32, and the second gear is press-fitted with the axle 11.

Specifically, the framework 2 is an H-shaped structure formed by connecting two side beams 21 and two transverse beams 22, the side beams 21 extend in a direction perpendicular to the axle 11 and are located on the outer side of the axle 11, and the transverse beams 22 extend in a direction parallel to the axle 11 and pass through between the two side beams 21. Further, the framework 2 may be also provided with a first suspension device 5, a second suspension device 6 and a traction device 7, as well as a braking device 8 located at the end portion of the framework 2.

The first suspension device 5 is arranged between the framework 2 and the axle 11, for cushioning the shocks and vibrations between the bogie and the axle. The second suspension device 6 is arranged on the side beams 21 of the framework 2, between the side beams 21, for cushioning the shocks and vibrations between the bogie and the vehicle body.

When a vehicle begins to run, the traction motor 32 starts, driving the rotation of the first gear 331 which is connected with the motor shaft 321 of the traction motor 32 and is located in the gearbox 33, the first gear 331 is engaged with the second gear 332 located in the gearbox 33, so as to drive the second gear 332 to rotate, and the second gear 332 may drive the axle of the wheelset to rotate since the second gear 332 is sleeved around the axle 11, thereby driving the wheelset to work.

In the meter gauge power bogie provided by the present invention, the driving device of the bogie is provided with a rolling axial suspension box 31 enclosing the axle 11, a front side or a rear side of the rolling axial suspension box 31 is provided with a traction motor 32, a gearbox 33 is arranged between the same ends of the traction motor 32 and the rolling axial suspension box 31 and the corresponding wheel 12, housings of the rolling axial suspension box 31 and the traction motor 32 are respectively fixedly connected with the box body of the gearbox 33, hence the rolling axial suspension box 31, the traction motor 32 and the gearbox 33 form an integral structure, which may be connected with the framework 2 via a motor derrick 4, rendering the structure of the driving device more compact, thus saving space for mounting the traction motor.

In addition, the first gear 331 in the gearbox 33 is press-fitted with the motor shaft 321 of the traction motor 32, the second gear 332 is press-fitted with the axle 11, traction power outputted from the traction motor 32 is directly imposed on the axle 11 of the wheelset via the gearbox 33, and the transmission between the traction motor 32 and the gearbox 33 is carried out in one stage, thus the transmission efficiency is relatively high.

Further, as shown in FIG. 4, every two of the box body of the gearbox 33, the traction motor 32 and the rolling axial suspension box 31 are connected via a bolt. Specifically, the box body of the gearbox 33 is fixedly connected with the traction motor 32 via a bolt, the traction motor 32 is fixedly connected with the rolling axial suspension box 31 via a bolt, and the box body of the gearbox 33 is fixedly connected with the rolling axial suspension box 31 via a bolt. Surely the box body of the gearbox 33, the traction motor 32 and the rolling axial suspension box 31 may be also fixedly connected in other manners to form an integral structure. As shown in FIG. 5, a dynamic sealing structure, specifically, a rotatable dynamic seal 333, is arranged between the box body of the gearbox 33 and the axle 11, that is to say, when a vehicle runs, the axle 11 and the wheel 12 rotate while the box body of the gearbox 33 remains stationary, resulting in relative rotation between the two, during which the arrangement of the dynamic sealing structure may realize sealing between the box body of the gearbox 33 and the axle.

Further, the gearbox 33 is a bearing single-stage gearbox, the box body of the gearbox 33 includes an upper half box and a lower half box, which are fixedly connected via a bolt. A first gear 331 and a second gear 332 is provided within the bearing type single-stage cylindrical gearbox, allowing reduction in power consumption caused by multi-stage gear transmission, thus ensuring the power outputted from the motor shaft 321 of the traction motor 32 is outputted to the axle 11 to the maximum extent.

Further, as shown in FIG. 2, the axles 11 of two adjacent wheelsets are parallel to each other, each of the wheelsets is provided with a driving device, the gearboxes 33 of two adjacent wheelsets are centrally symmetric about the center of the bogie, and the traction motors 32 of two adjacent wheelsets are centrally symmetric about the center of the bogie. Specifically, the bogie has a longitudinal central axis in a longitudinal direction of the vehicle body and a transverse central axis across the vehicle body, wherein the longitudinal central axis intersects with the transverse central axis at the center of the bogie.

Specifically, in two adjacent wheelsets, the traction motor 32 of the wheelset on the front side may be arranged on the rear side of the axle of the wheelset, and the traction motor 32 of the wheelset on the rear side may be arranged on the front side of the axle of the wheelset, allowing the traction motors 32 of the two adjacent wheelsets to be located between the two wheelsets and on both sides of the two transverse beams 22, while enabling the two traction motors 32 to be fixed on the transverse beams 22 of the framework 2 via the motor derrick. The two traction motors 32 are centrally symmetric about the center of the bogie, and the gearboxes 33 of two wheelsets are centrally symmetric about the center of the bogie, so that the two traction motors 32 and two gearboxes 33 located on both sides of the two transverse beams 22 can occupy complementary spaces, rendering the structure of the bogie more compact.

Further, the framework 2 includes two side beams 21 and two transverse beams 22, the side beam 21 is a slender box-like structure formed by tailored welding of a forged piece and a steel plate, and each of the side beams 21 is a concave structure with the middle portion lower than the end portions along the length; the transverse beam 22 is a seamless steel tube passing through between the two side beams 21, and the two transverse beams 22 are located between two wheelsets, preferably, the two transverse beams 22 pass through the concave middle portions of the side beams 21. One end of the motor derrick 4 is fixedly connected with the housing of the traction motor 32, and the other end is fixedly connected with the transverse beam 22.

Further, the first suspension device 5 includes a steel spring, which is arranged between an axle box for positioning the wheelset and the framework 2.

The second suspension device 6 includes two air springs, a height control valve, and a differential pressure valve mounted between the two air springs; the air springs are fixed on the side beams 21 of the framework 2 for bearing the weight of the vehicle body, as well as providing a transverse displacement and a change in rotation between the vehicle body and the bogie. The height control valve is used for controlling the working height of the air springs, correcting a height deviation of the vehicle body relative to the bogie, so as to keep a constant height of a vehicle when the vehicle are under different loads.

Further, the traction device 7 includes a traction seat and a traction rod, the traction rod is preferably a Z-shaped traction rod structure, one end of the traction rod is connected with the traction seat while the other end is reversely arranged and connected with a traction rod seat on the transverse beams 22, allowing the traction rod to form a Z-shaped structure with the traction seat. The Z-shaped traction rod structure simplifies structure of the traction device, and can realize low-level traction and mounting.

Further, the braking device 8 adopts a wheel disc to realize braking, each wheel of the two wheelsets is correspondingly provided with a braking device 8 for braking the wheel disc of the wheel, and the braking device 8 is mounted on the side beams 21 of the framework 2. A braking unit of the braking device 8 is suspended at four corners of the framework around the wheel, thereby saving space between the two wheels, and facilitating reducing the distance between two axles.

The present invention also provides a meter gauge vehicle, including the above meter gauge power bogie, and a vehicle body arranged on the meter gauge power bogie, wherein the meter gauge power bogie is provided with a traction motor 32 at a front side or a rear side of a rolling axial suspension box 31, via the rolling axial suspension box 31 enclosing an axle 11 in a driving device of the bogie; a gearbox 33 is arranged between the same ends of the traction motor 32 and the rolling axial suspension box 31 and a corresponding wheel 12, every two of the rolling axial suspension box 31, a housing of the traction motor 32 and the box body of the gearbox 33 are fixedly connected, as a result, the rolling axial suspension box 31, the traction motor 32 and the gearbox 33 form an integral structure, which may be connected to a framework 2 via a motor derrick 4, rendering the structure of the driving device more compact, thus saving space for mounting the traction motor, and hence the driving device is able to be provided with a traction motor with a greater traction power, so as to improve the running speed of a meter gauge vehicle.

Finally it should be stated that, the above embodiments are merely intended to illustrate rather than limit the technical solutions of the present invention; although the present invention has been described in detail in conjunction with the above embodiments, one with ordinary skill in the art should understand that, modifications can still be made to the technical solutions recorded in the above embodiments, or that equivalent substitutions can still be made to part or all of the technical solutions; and neither these modifications nor these substitutions shall make the essence of the corresponding technical solutions to deviate from the scope of the technical solutions in the embodiments of the present invention.

What is claimed is:

1. A meter gauge power bogie, comprising two wheelsets arranged in a longitudinal direction of a vehicle body, a framework arranged on the wheelsets, wherein the wheelset comprises an axle extending along a width of the vehicle body and wheels press-fitted with the axle and located at both ends of the axle, wherein the meter gauge power bogie further comprises:

a driving device, comprising a rolling axial suspension box enclosing the axle between the two wheels, wherein the rolling axial suspension box is mounted on the axle via a rolling bearing; a traction motor is arranged on a front side or a rear side of the rolling axial suspension box, and a gearbox is arranged between ends of the traction motor and the rolling axial suspension box at the same side and the corresponding wheel; the rolling axial suspension box is fixedly connected with a housing of the traction motor, the rolling axial suspension box and the housing of the traction motor are respectively fixedly connected with a box body of the gearbox; the housing of the traction motor is connected with the framework via a motor derrick; a first gear and a second gear are at least provided within the gearbox, the first gear is press-fitted with a motor shaft of the traction motor, and the second gear is press-fitted with the axle, wherein, every two of the gearbox box body, the traction motor and the rolling axial suspension box are connected with a bolt; and a dynamic sealing structure is arranged between the gearbox box body and the axle, the dynamic sealing structure is a rotatable dynamic seal.

2. The meter gauge power bogie in accordance with claim 1, wherein, the gearbox is a bearing single-stage gearbox, the box body of the gearbox comprises an upper half box and a lower half box, which are fixedly connected with a bolt.

3. The meter gauge power bogie in accordance with claim 1, wherein, axles of two adjacent wheelsets are arranged in parallel, the gearboxes of two adjacent wheelsets are centrally symmetric about the center of the bogie, and the traction motors of two adjacent wheelsets are centrally symmetric about the center of the bogie.

4. The meter gauge power bogie in accordance with claims 1, wherein, the framework is an H-shaped structure formed by connecting two side beams with two transverse beams, the side beams extend in a direction perpendicular to the axle and are located on the outer side of the axle, the transverse beams extend in a direction parallel with the axle and pass through between the two side beams.

5. The meter gauge power bogie in accordance with claim 4, wherein, the two transverse beams are located between the two wheelsets, one end of the motor derrick is fixedly connected with the housing of the traction motor, and the other end fixedly connected with one of the transverse beams near the motor derrick.

6. The meter gauge power bogie in accordance with claim 4, wherein, a braking device, which is mounted on the side beam, is arranged correspondingly on each of the wheels for braking a wheel disc of the wheel.

7. A meter gauge vehicle, comprising a meter gauge power bogie in accordance with claim 1, and a vehicle body arranged on the meter gauge power bogie.

* * * * *